US006761595B1

(12) United States Patent
Zheng et al.

(10) Patent No.: US 6,761,595 B1
(45) Date of Patent: Jul. 13, 2004

(54) ELECTRICAL CONNECTOR

(75) Inventors: Qisheng Zheng, Kunsan (CN); Zhenghua Xu, Kunsan (CN); JunXian Liu, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/253,954

(22) Filed: Sep. 23, 2002

(30) Foreign Application Priority Data

Jun. 28, 2002 (TW) ..... 91209758 U

(51) Int. Cl.[7] ..... H01R 24/00; H01R 13/66
(52) U.S. Cl. ..... 439/676; 439/620
(58) Field of Search ..... 439/676, 620

(56) References Cited

U.S. PATENT DOCUMENTS

| | | | | |
|---|---|---|---|---|
| 5,531,612 A | | 7/1996 | Goodall et al. | 439/541.5 |
| 5,639,267 A | | 6/1997 | Loudermilk | 439/701 |
| 5,647,767 A | | 7/1997 | Scheer et al. | 439/620 |
| 6,132,260 A | | 10/2000 | Wu | 439/676 |
| 6,206,725 B1 | | 3/2001 | Wu | 439/541.5 |
| 6,220,900 B1 | | 4/2001 | Huang | 439/676 |
| 6,302,741 B1 | * | 10/2001 | Fasold et al. | 439/620 |
| 6,474,999 B1 | * | 11/2002 | Givens et al. | 439/76.1 |
| 6,511,348 B1 | * | 1/2003 | Wojtacki et al. | 439/620 |
| 6,554,638 B1 | * | 4/2003 | Hess et al. | 439/490 |
| 2002/0081908 A1 | * | 6/2002 | Ahn et al. | 439/676 |
| 2002/0146940 A1 | * | 10/2002 | Colantuono et al. | 439/676 |
| 2002/0160663 A1 | * | 10/2002 | Gutierrez et al. | 439/676 |
| 2003/0087559 A1 | * | 5/2003 | Korsunsky et al. | 439/676 |

* cited by examiner

*Primary Examiner*—Michael C. Zarroli
(74) *Attorney, Agent, or Firm*—Wei Te Chung

(57) ABSTRACT

An electrical connector (9) has an insulative housing (1) and a plurality of subassemblies (3). Each subassembly has a base member (4), a first and second printed circuit boards (PCBs, 72, 73), a pair of insert portions (6) mounted on corresponding PCBs, and a plurality of terminals (5) insert molded in the insert portions. One of the insert portions has a plurality of first positioning posts (62) and first mounting holes (63), the other insert portion has a plurality of second positioning posts (67) and mounting holes (68) second stably engaging with the first mounting holes and the first positioning posts of the former. The base member has a plurality of magnetic coils connecting with the terminals.

8 Claims, 7 Drawing Sheets

ELECTRICAL CONNECTOR

CROSS-REFERENCE TO RELATED APPLICATION

This present application is related to a contemporaneously filed US patent applications entitled "MULTI-PORT MODULAR JACK ASSEMBLY WITH DETACHABLE INSERT SUBASSEMBLES", and "ELECTRICAL CONNECTOR WITH INSERT-MOLDING STRUCTURE", invented by the same inventor, and assigned to the common assignee.

BACKGROUND OF THE INVENTION

1. Field of the Invention

The present invention generally relates to an electrical connector, and more particularly to a stacked modularjack.

2. Description of the Prior Art

Modular jacks are often used in computers to interconnect the computers with electronic peripheral equipments. As multi-function trend becomes more popular in computer industry, while spaces on printed circuit boards (PCBs) of the computers are limited, stacked modular jacks have been widely adopted in electrical connectors.

U.S. Pat. No. 5,639,267, issued to Loudermilk on Jun. 17, 1997, discloses a modular jack having a housing with a rear loading bay, and a backplate sub-assembly with an L-shaped backplate and a plurality of contact pin arrays mounted to the L-shaped backplate. A plurality of channels are formed in inner walls of the L-shaped backplate. Each contact pin array has an L-shaped unitary insulative member engaging with the channels of the L-shaped backplate. The backplate sub-assembly further has a shield plate disposed between two rows of the contact pin arrays. The backplate sub-assembly is received in the rear loading bay of the housing.

However, there is no engaging means between the two rows of the contact pin arrays, so that during the process of assembling the sub-assembly to the housing, the two contact pin arrays may relatively move, and the contact pins of the modular jack may be deformed under high temperature. Furthermore, such a modular jack without filter components cannot satisfy a high frequency application.

Hence, an improved modular jack is needed to eliminate the above-mentioned defects of the conventional modular jacks.

BRIEF SUMMARY OF THE INVENTION

The main object of the present invention is to provide an electrical connector with terminals of subassemblies fixed relatively.

An electrical connector according to the present invention has an insulative housing, a plurality of subassemblies. Each subassembly has a base member, a first, second and third printed circuit boards (PCBs), a pair of insert portions respectively mounted on the first and second PCBs, and a plurality of terminals insert molded in the insert portions. One of the insert portions has a first upper surface, a first pair of positioning posts protruding on first the upper surface, a first pair of mounting holes defined in the first upper surface, and a first latch formed on one lateral side thereof. The other insert portion has a second upper surface, a second pair of positioning posts and a second pair of mounting holes respectively protruding on and defined in the second upper surface, and a second latch formed on one lateral side thereof. The first positioning posts and the first mounting holes engage with corresponding second mounting holes and second positioning posts. The first, second and third PCBs respectively have a plurality of through holes. The base member has a plurality of contacts for soldering to or engaging with the through holes of the first, second and third PCBs.

Other objects, advantages and novel features of the invention will become more apparent from the following detailed description of a preferred embodiment when taken in conjunction with the accompanying drawings.

DETAILED DESCRIPTION OF THE INVENTION

Figure 1:
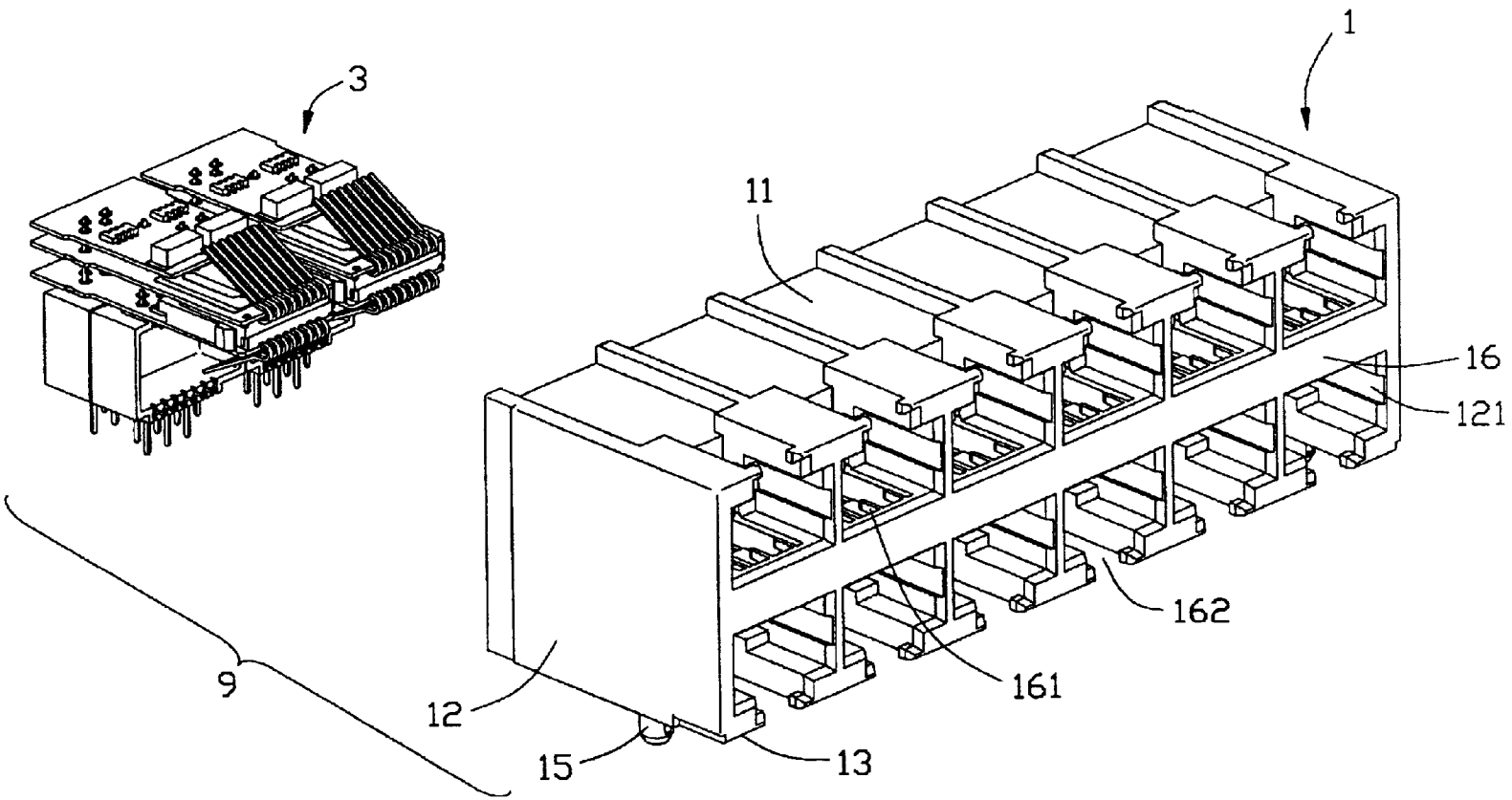
FIG. 1 is an exploded view of an electrical connector of the present invention, just showing two subassemblies thereof.
Figure 2:
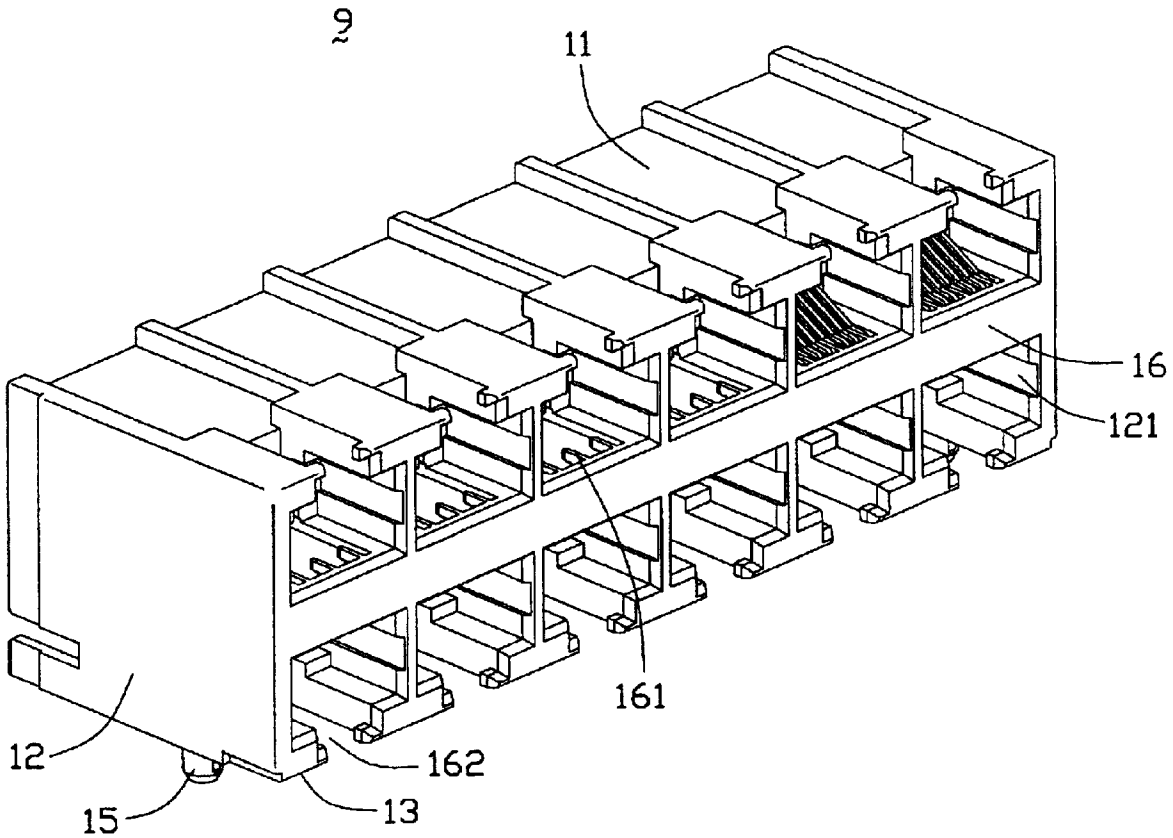
FIG. 2 is an assembled view of FIG. 1.
Figure 3:
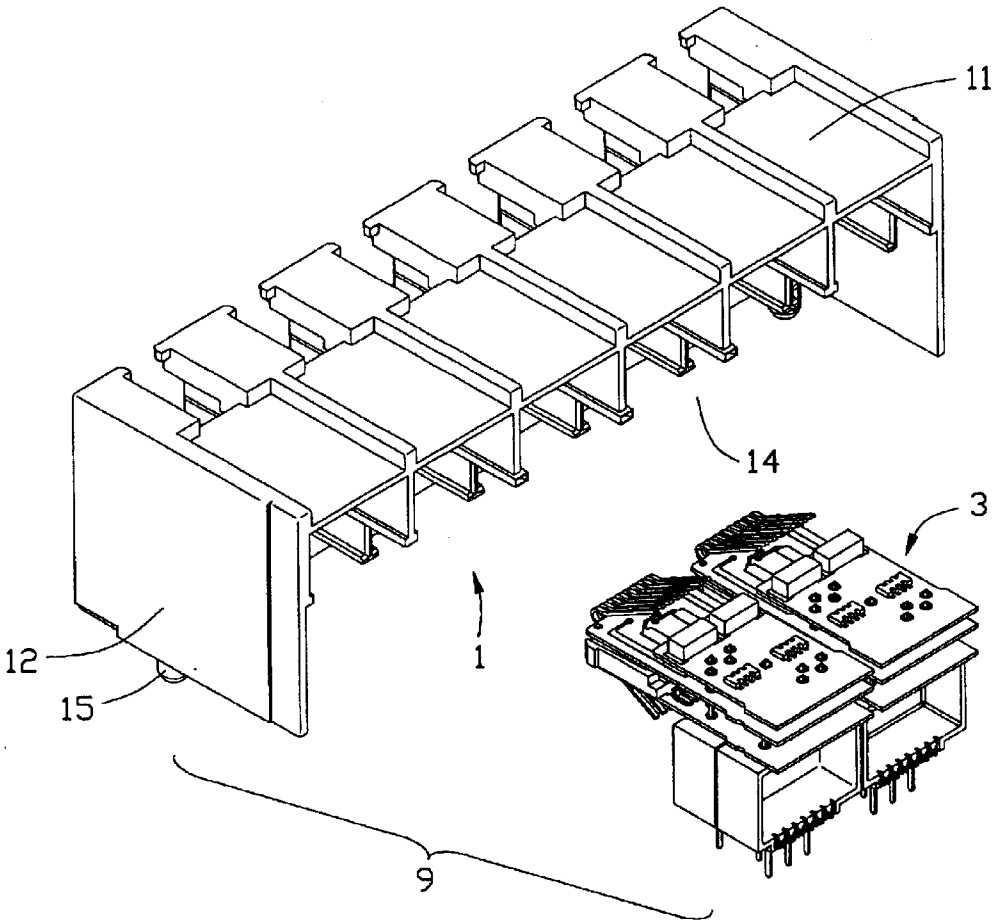
FIG. 3 is another view of FIG. 1.
Figure 4:
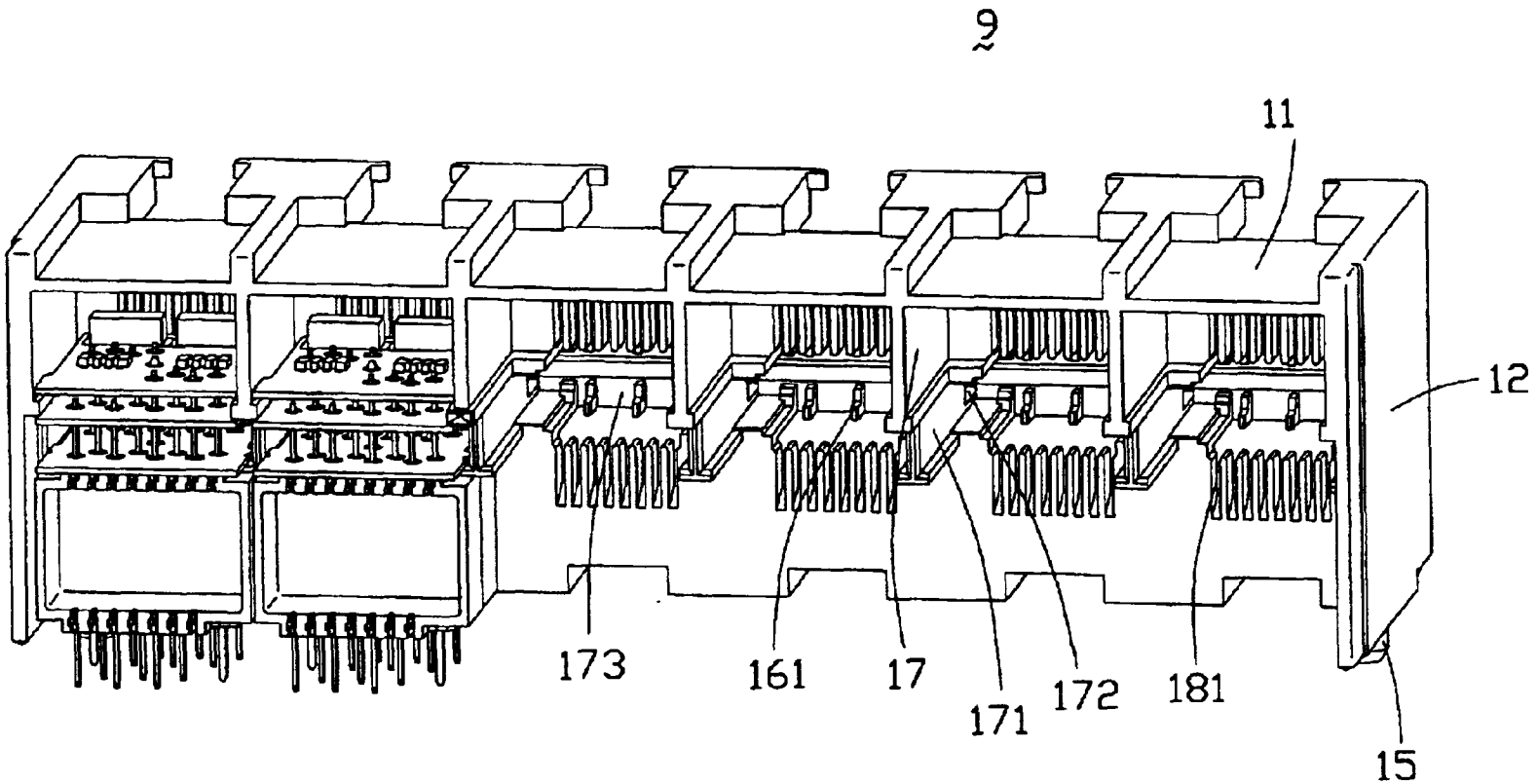
FIG. 4 is an assembled view of FIG. 3.
Figure 5:
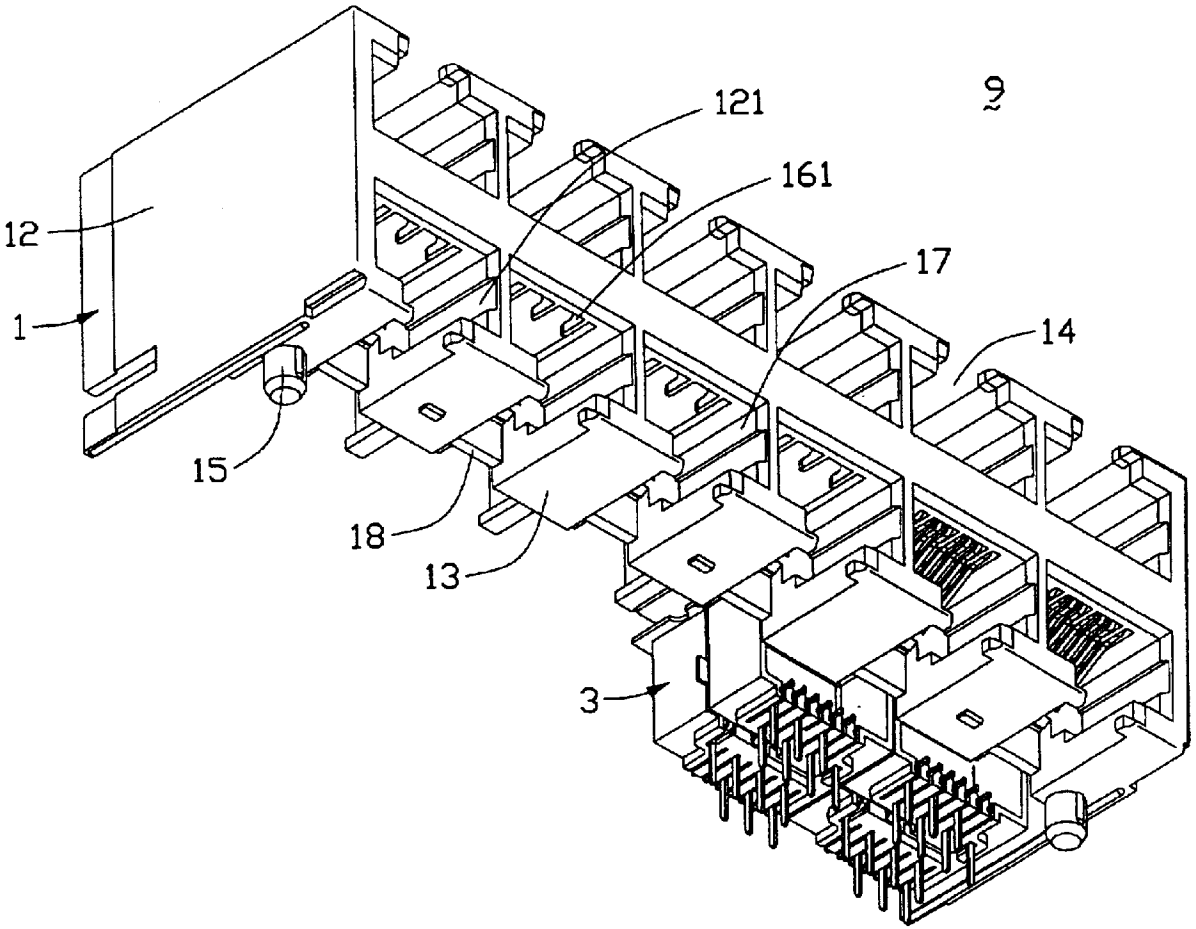
FIG. 5 is another view of FIG. 4.

Referring to FIGS. 1–5, an electrical connector 9 of the present invention has an insulative housing 1, a plurality of subassemblies 3 received in the insulative housing 1.

The housing 1 has a top wall 11, a pair of side walls 12, a bottom wall 13, a front wall 16, a plurality of clapboards 17, and a plurality of partitioners 18. The plurality of clapboards 17 are longitudinally formed between the two side walls 12 with proportional spacing, and the plurality of partitioners 18 are transversely formed between every two clapboards 17 or between the clapboard 17 and the side wall 12. Each partitioner 18 defines a plurality of slots 181. The side walls 12 and the clapboards 17 together define a plurality of mating openings 162 for receiving complementary plugs (not shown). The mating openings 162 are arranged in an upper and lower rows, and the mating openings 162 in the upper row have mirror-image structures to the mating openings 162 in the lower row. The side walls 12 and the clapboards 17 define a plurality of grooves 121 for receiving engaging parts of the complementary plugs. The bottom wall 13 of the housing 1 has a pair of poles 15 depending downwardly therefrom. The front wall 16 forms a plurality of L-shaped tabs 161 on a rear surface thereof and extending into the mating openings 162 of the housing 1. Each clapboard 17 has a block 171, and a notch 172 defined in the block 171. Adjacent blocks 171 and the side walls 12 and corresponding blocks 171 adjacent to the side walls 12 define a channel 173 for receiving corresponding subassemblies 3 of the electrical connector 9.

Figure 6:
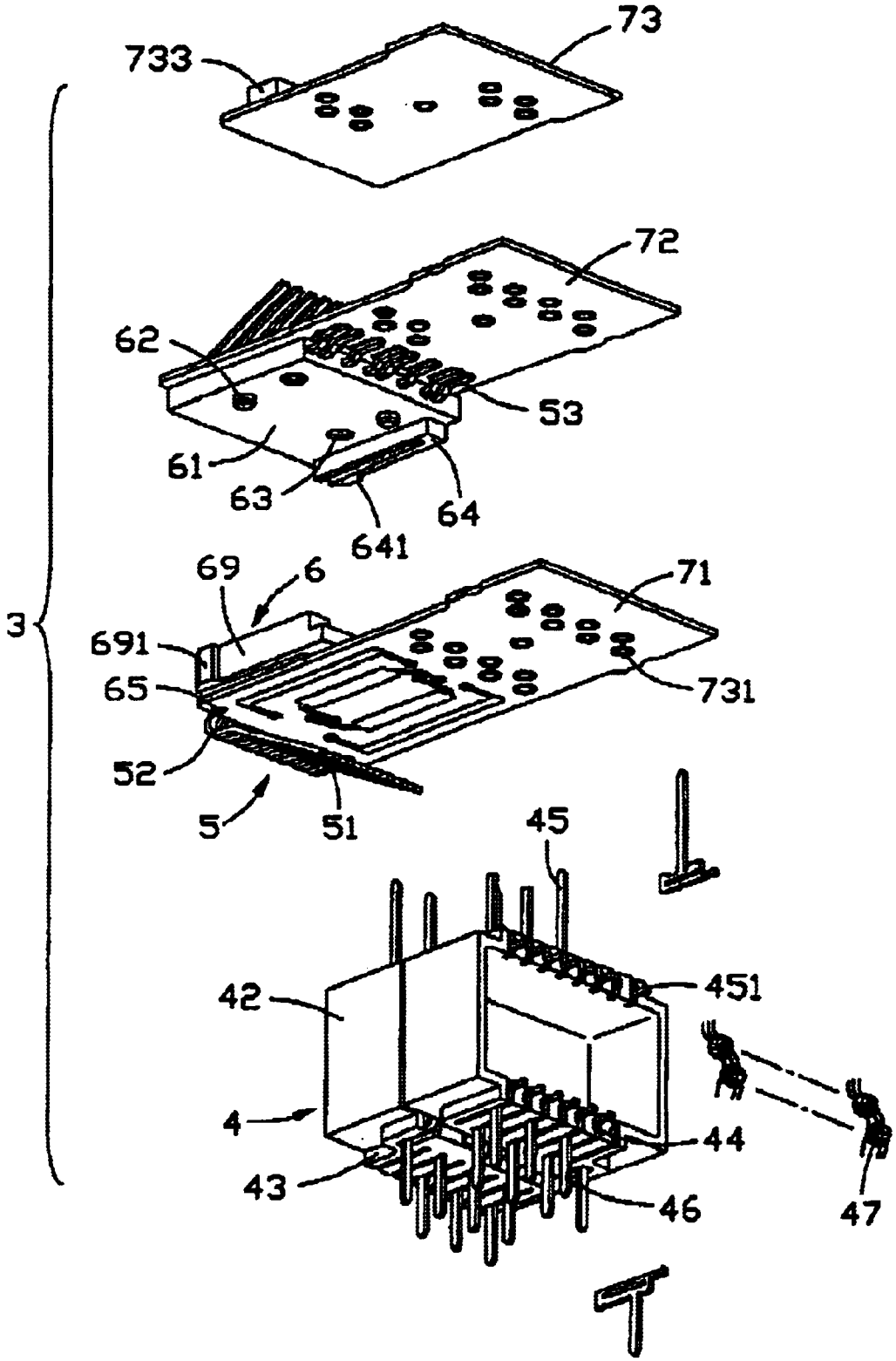
FIG. 6 is an exploded view of a subassembly of the electrical connector.
Figure 7:
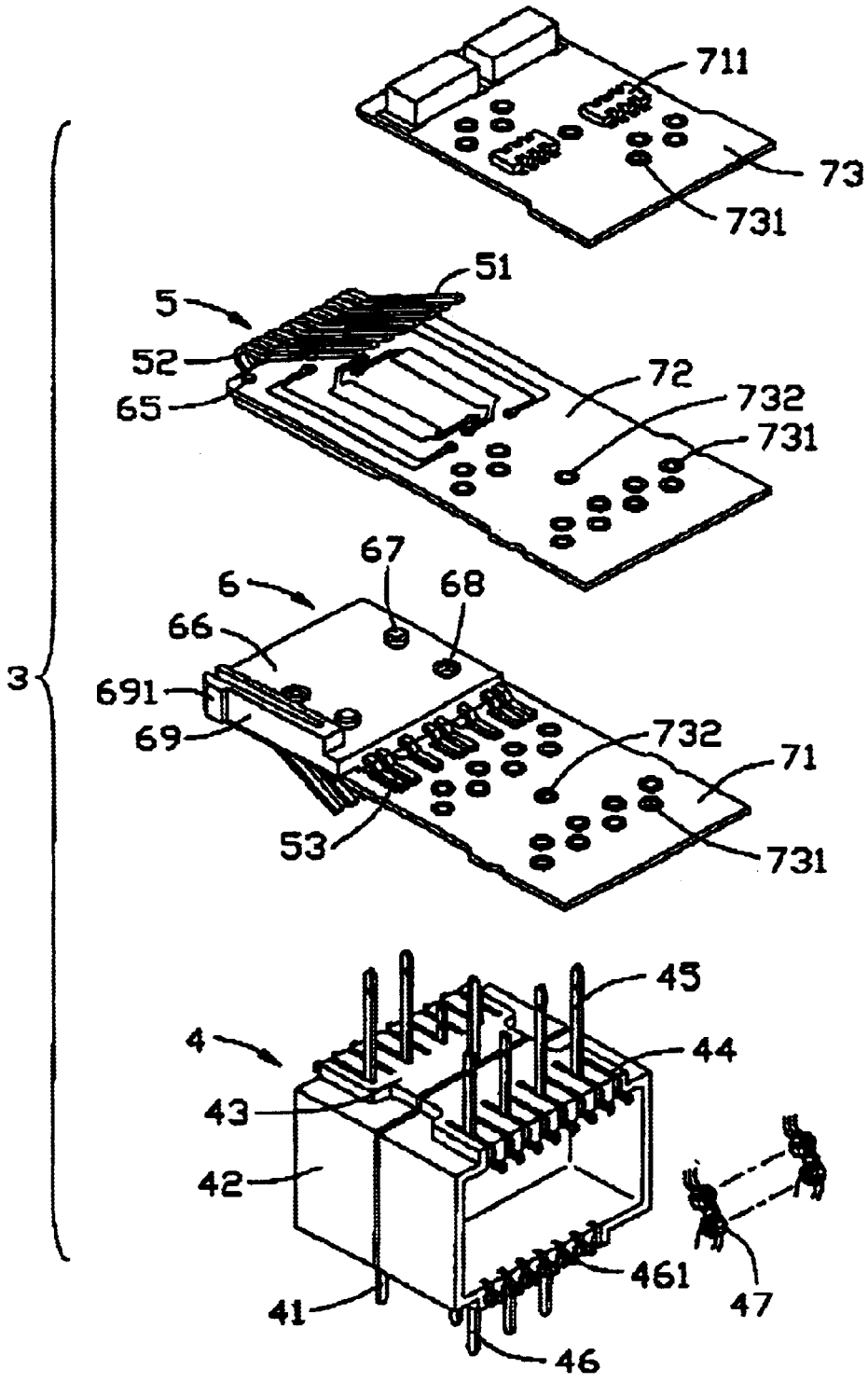
FIG. 7 is another view of FIG. 6.

Referring to FIGS. 6 and 7, each subassembly 3 has a base member 4, a first printed circuit board (PCB) 71, a second PCB 72, a third PCB 73, and an interengaging device 6 arranged between the first and second PCBs 71, 72. The interengaging device 6 comprises a pair of split insert portions 6 respectively mounted onto the first and second PCBs 71, 72. A plurality of terminals 5 are respectively insert molded with the pair of split insert portions 6.

The base member 4 has a pair of magnetic module receptacles 42 positioned back-to-back, a grounding bar 41 sandwiched in between the magnetic module receptacles 42. The magnetic module receptacles 42 have flat portions 43 respectively formed on an upper and lower surfaces of the magnetic module receptacles 42, and a plurality of contacts 45, 46 received in upper and lower walls (not labeled) of the magnetic module receptacles 42. The contacts 45, 46 respectively have a plurality of intervening portions 451, 461. Each flat portion 43 defines a plurality of recesses 44 for receiving corresponding intervening portions 451, 461 of the contacts 45, 46. The base member 4 further has a plurality of magnetic coils 47 received in the magnetic module receptacles 42 and interconnecting the contacts 45, 46 for both transmitting signals and filtering noises.

The terminals 5 have contacting sections 51, C-shaped spring sections 52, connecting sections insert molded in corresponding insert portions 6, and soldering sections 53 extending rearwardly from the connecting section for soldering to surfaces of the first PCB 71 and the second PCB 72.

The pair of insert portions 6 of each subassembly 3 respectively have a first and second upper surfaces 61, 66, a first and second pairs of positioning posts 62, 67 diagonally protruding on corresponding first and second upper surfaces 61, 66, a first and second pairs of mounting holes 63, 68 diagonally defined in corresponding first and second upper surfaces 61, 66 and aligned with corresponding pair of positioning posts 67, 62, and a first and second latches 64, 69 formed on lateral sides of corresponding insert portions 6 for engaging with corresponding blocks 171 of the housing 1. The first and second latches 64, 69 has a first and second clasps 641, 691 formed on front portions of the first and second latches 64, 69 for engaging with corresponding notches 172 of the housing 1. Both the insert portions 6 have a pair of engaging portions 65 formed on lower surfaces opposite to corresponding first and second upper surfaces 61, 66 thereof.

The third PCB 73 has a plurality of filtering elements 733 mounted on an upper surface thereof for filtering noises. The second PCB 72 has one of the insert portions 6 mounted on a lower surface thereof, and the first PCB 71 has the other insert portion 6 mounted on an upper surface thereof. The first, second and third PCBs 71, 72, 73 respectively have a plurality of through holes 732, 731 for the grounding bar 41 and the contacts 45, 46 extending through.

Referring to FIGS. 1–7, in assembly, the insert portions 6 together with the terminals 5 are respectively placed on the upper surface of the first PCB 71 and the lower surface of the second PCB 72. The engaging portions 65 of the insert portions 6 engage with corresponding holes (not labeled) of the first and second PCBs 71, 72. The soldering sections 53 of the terminals 5 are respectively soldered to the upper surface of the first PCB 71 and the lower surface of the second PCB 72.

The intervening portions 451, 461 of the contacts 45, 46 are received in corresponding recesses 44 of the magnetic module receptacles 42. The first PCB 71 is disposed above the base member 4, the contacts 45 of the rear magnetic module receptacles 42 extend through corresponding through holes 731 of the first PCB 71, and the contacts 45 of the front magnetic module receptacle 42 are soldered to the first PCB 71 for transmitting signals. The grounding bar 41 extends through the through hole 732 of the first PCB 71.

The second PCB 72 is disposed above the first PCB 71, the first positioning posts 62 and the first mounting holes 63 of the insert portion 6 on the second PCB 72 engage with corresponding second mounting holes 68 and the second positioning posts 67 of the insert portion 6 on the first PCB 71. The contacts 45 of the rear magnetic module receptacle 42 are soldered to the second PCB 72 for transmitting signals. The grounding bar 41 and several contacts 45 of the front magnetic module receptacle 42 are respectively extending through the through holes 732, 731 of the second PCB 72.

The third PCB 73 is disposed above the second PCB 72, and several contacts 45 of each magnetic module receptacle 42 are soldered to the third PCB 73 for filtering noises. The ground bar 41 is soldered to the through hole 732 of the third PCB 73, thereby finishing the assembly of the subassembly 3.

The inserted subassembly 3 is inserted into a corresponding channel 173 of the housing 1. The first and second latches 64, 69 of the subassembly 3 engage with corresponding blocks 171 of the housing 1 with the clasps 641 thereof received in corresponding notches 172. Free ends of the contacting sections 51 of the terminals 5 are received in corresponding slots 181 of the partitioners 18 of the housing 1 preventing the contacting sections 51 being deformed in a lateral direction. The tabs 161 of the housing 1 hold the first and second PCBs 71, 72 firmly.

An advantage of the present invention over the prior art is that the first positioning posts 62 and the first mounting holes 63 of one insert portion 6 engage with corresponding second mounting holes 68 and second positioning posts 67 of the other insert portion 6, and the first and second latches 64, 69 of the subassembly 3 engage with corresponding blocks 171 of the housing 1. As a result, after the subassembly 3 is assembled in the housing, the first and second PCBs 71, 72 are secured with each other firmly. Another advantage is that the terminals 5 are insert molded in the insert portions 6 and mounted together by the mounting holes 63 engaging with positioning posts 62, thus, one insert portion 6 with the terminals 5 could be replaced easily by a new one when the terminals 5 are destroyed.

It is to be understood, however, that even though numerous, characteristics and advantages of the present invention have been set forth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

an insulative housing;

a first terminal insert, the first terminal insert having a first printed circuit board (PCB) and a plurality of first terminals arranged on the first PCB;

a second terminal insert, the second terminal insert having a second PCB and a plurality of second terminals arranged on the second PCB;

an interengaging device arranged between the first and second terminal inserts so as to attach the first terminal insert to the second terminal insert; and a magnetic module electrically connected to the first and second terminals via the first and second PCBs; wherein the first and second inserts, the interengaging device and the magnetic module are received in the housing; wherein the first insert portion has a positioning post, and the second insert portion has a mounting hole, the positioning post engaging with the mounting hole; wherein the magnetic module comprises a first and second insulative receptacles, a grounding bar sandwiched between the first and second receptacles, a plurality of magnetic coils received in the first and second receptacles, and a plurality of conductive contacts electrically mounted on the first and second receptacles, the conductive contacts connected with corresponding magnetic coils; wherein the contacts extend to be soldered to corresponding first, second or third PCBs, the terminals on the first and second PCBs, the magnetic coils of the magnetic module and the filtering elements on the third PCB electrically connected via said contacts.

2. The electrical connector as claimed in claim 1, wherein the interengaging device has a first and second insert portions respectively mounted on the first and second PCBs, the first insert portion insert molded the first terminals therein, the second insert portion insert molded second terminals therein.

3. The electrical connector as claimed in claim 2, wherein the first and second insert portions respectively have a first and second latches engaging with the insulative housing.

4. The electrical connector as claimed in claim 2, wherein the first insert portion has a pair of first engaging portions engaging with the first PCB, and wherein the second insert portion has a pair of second engaging portions engaging with the second PCBs.

5. The electrical connector as claimed in claim 1, wherein the housing has a front wall, the front wall forming a plurality of tabs on an inner surface thereof holding the first and the second PCBs.

6. The electrical connector as claimed in claim 1, further comprising a third PCB having a plurality of filter elements arranged thereon.

7. An electrical connector, comprising:

an insulative housing; and a subassembly received in the housing, comprising:

a first PCB module having a first PCB, a first insert portion assembled with the first PCB, and a plurality of first terminals disposed in the first insert portions, the first insert portion having a positioning post;

a second PCB module having a second PCB, a second insert portion assembled with the second PCB, and a plurality of second terminals disposed in the second insert portion, the second insert portion having a mounting hole engaging with the positioning post of the first insert portion; and a magnetic module assembled with the first and second PCBs and electrically connecting with the first and second terminals; wherein the first insert portion has a positioning post, and the second insert portion has a mounting hole, the positioning post engaging with the mounting hole; wherein the magnetic module comprises a first and second insulative receptacles, a grounding bar sandwiched between the first and second receptacles, a plurality of magnetic coils received in the first and second receptacles, and a plurality of conductive contacts electrically mounted on the first and second receptacles, the conductive contacts connected with corresponding magnetic coils; wherein the contacts extend to be soldered to corresponding first, second or third PCBs, the terminals on the first and second PCBs, the magnetic coils of the magnetic module and the filtering elements on the third PCB electrically connected via said contacts.

8. An electrical connector comprising:

an insulative housing;

a first terminal insert having a first printed circuit board (PCB) and a plurality of first terminals arranged on the first PCB;

a second terminal insert having a second PCB and a plurality of second terminals arranged on the second PCB;

another printed circuit board spatially located away from said first and second printed circuit boards while electrically connected thereto; and an interengaging device arranged between the first and second terminal inserts so as to fasten the first terminal insert and the second terminal insert together; wherein said interengaging device supportably spaces the first printed circuit board and the second printed circuit board away from each other in a parallel relation; wherein the first insert portion has a positioning post, and the second insert portion has a mounting hole, the positioning post engaging with the mounting hole; wherein the magnetic module comprises a first and second insulative receptacles, a grounding bar sandwiched between the first and second receptacles, a plurality of magnetic coils received in the first and second receptacles, and a plurality of conductive contacts electrically mounted on the first and second receptacles, the conductive contacts connected with corresponding magnetic coils; wherein the contacts extend to be soldered to corresponding first, second or third PCBs, the terminals on the first and second PCBs, the magnetic coils of the magnetic module and the filtering elements on the third PCB electrically connected via said contacts.

* * * * *